United States Patent [19]

Vogt

[11] 4,265,367

[45] May 5, 1981

[54] EASY OPENING TOP CLOSURE MEMBER FOR A CONTAINER

[76] Inventor: Kuno J. Vogt, 4250½ Fairmount Ave., San Diego, Calif. 92105

[21] Appl. No.: 125,649

[22] Filed: Feb. 28, 1980

[51] Int. Cl.[3] ..... B65D 17/34

[52] U.S. Cl. ..... 220/269; 220/270; 220/335; 215/1 C; 150/0.5; 222/541

[58] Field of Search ..... 220/266, 269, 270, 335; 215/1 C, 254; 150/0.5; 222/541

[56] References Cited

U.S. PATENT DOCUMENTS

| | | | |
|---|---|---|---|
| 3,380,608 | 4/1968 | Morleck | 215/1 C |
| 3,966,080 | 6/1976 | Bittel | 220/269 |
| 3,981,412 | 9/1976 | Asmus | 220/270 |

*Primary Examiner*—George T. Hall
*Attorney, Agent, or Firm*—Charles C. Logan, II

[57] ABSTRACT

A container having an easy opening top closure member. The container has a body portion and a top closure wall member of a predetermined thickness. The top closure wall member has an outer surface and an inner surface. A groove is formed on the inner surface to define a tab-like closure member. A ridge member extends outwardly from the top surface of the closure wall member and the ridge member is positioned above and opposite to the groove. The lower portion of the ridge member is frangibly connected to the outer surface of the top closure wall member whereby the ridge member is frangibly separated from the outer surface of the top closure wall member, the tab-like closure member can be lifted upwardly to expose the interior of the body portion of the container. A gripping member is formed adjacent the free end of the ridge member to aid in tearing the ridge member free from the top of the top closure wall member. The top closure wall member is made of plastic material. The tab-like closure member has a hinge portion that will keep it structurally tied to the top closure wall member. The top surface of the tab-like closure member has a recessed hold-down locking structure that mates with a protrusion extending upwardly from the bottom portion for locking the tab-like closure member in an open position.

12 Claims, 13 Drawing Figures

EASY OPENING TOP CLOSURE MEMBER FOR A CONTAINER

BACKGROUND OF THE INVENTION

The invention relates in general to container structure and more specifically to an easy opening top closure member for a container.

The popularity of the conventional pop-top beverage container has caused the problem of littering resulting from improper disposal of the tear tab that is detached to the open container. These removable tear tabs which typically have sharp or rough metal edges, are frequently dropped on the ground as soon as the can is opened, thereby creating an unsightly and hazardous situation. Public criticism and dissatisfaction with the conventional pop-top beverage can, with its removable tear tab, has increased to the point where a number of jurisdictions have outlawed such beverage containers or are contemplating doing so.

A preferred solution to the problems created by the conventional pop-top would be an easy opening container which is manually operable by children as well as adults, which provides an effective pouring opening once opened, which presents no psychological barriers to opening or beverage consumption, which is readily producable, and which is economically feasible. While many designs of easy-opening containers have been proposed as substitutions for the pop-top, none is known which effectively meets all foregoing criteria to the satisfaction of the container manufacturer, the beverage packager, and the consumer of canned beverages.

One of the attempts to solve the littering problem is illustrated in U.S. Pat. No. 3,902,626. In the structure illustrated therein, the top of the container has had weakening indentations formed in the exterior surface to provide a fracturable web at the root of the indentation adapted to be fractured by inwardly directed pressure digitally applied against an integral outwardly projecting deflectable portion of the container component around the opening panel. This structure still has the drawback that the opening panel is pushed through the opening in the lid into the contents of the container thereby providing a danger of the opening panel being swallowed. Additionally as the opening panel is pushed through the top of the container there remains the risk of cutting or severing the fingertip as it is pushing the opening panel through the aperture formed in the top of the container.

Other attempts have been made to design non-detachable easy open flap and tab assemblies such as are illustrated in U.S. Pat. Nos. 3,938,693 and 4,039,100. The major problem with the structure ellustrated in these patents is their costliness of manufacture. Both of these structures eliminate the littering problem and also the danger of cutting the finger which is used to open the top.

It is an object of the invention to provide a novel easy opening top closure member for a container that may be non-detachable from the container.

It is also an object of the invention to provide a novel easy opening top closure member for a container that eliminates the danger of cutting one's finger when the top closure member is opened.

It is also an object of the invention to provide a novel easy opening top closure member for a container that will not be deposited within the container in such a manner as to provide a danger that the person drinking from the container may swallow the top closure member.

It is a further object of the invention to provide a novel easy opening top closure member for a container that is inexpensive to manufacture.

It is an additional object of the invention to provide a novel container which is filled from the bottom, allowing high-speed filling of narrow-neck of small-opening containers.

SUMMARY OF THE INVENTION

The easyopening top closure member is utilized in a novel container structure. The plastic container has a body portion having a top closure wall member of a predetermined thickness. The top closure wall member has an outer surface and an inner surface. A groove is formed on the inner surface of the top closure wall member to define a tab-like closure member. A ridge member extends outwardly from the outer surface of the top closure wall member and it has a gripping member formed on its free end. The bottom of the ridge member is frangibly connected to the outer surface of the top closure wall member whereby when the ridge member is frangibly separated from the outer surface of the top closure wall member, the tab-like closure member can be lifted upwardly to expose the interior of the body portion of the container. The ridge member is positioned on the outer surface of the top closure wall member opposite the groove. The tab-like closure member has a hinge portion. The outer surface of the tab-like closure member also has a hold down locking structure for locking the tab-like closure member in an open position.

The novel container can be made from plastic which produces a built-in easy-open top that is is fromable intregrally with the top of the container. A container can thus be formed having an easy opening top that needs no affixing to the body of the container and yet the closure can be easily opened by hand. The shape of the body of the container that can be used is quite versatile thus allowing frusto-conical shapes, retangular shapes, etc. Where the body of the container is frusto conical, the empty bodies can be nested to significantly cut down on the amount of storage space required for them. Savings also occur in the handling and transportation of container bodies that may be nested. Also the problem of dirt accumulating inside a can or bottle that is open at its top end is eliminated by the ability to nest the open bodies of the container. The novel container could either have a one or a two piece bottom structure. If a one piece structure is utilized, the bottom wall and the bottom of the container body can have their edges crimped together in some conventional manner. Where a two piece bottom is utilized, one bottom wall member would telescope within the bottom of the body portion of the container and an annular securing ring member would capture that bottom wall member and prevent its engagement from the body portion of the container.

DESCRIPTION OF THE PREFERRED EMBODIMENTS

Figure 1:
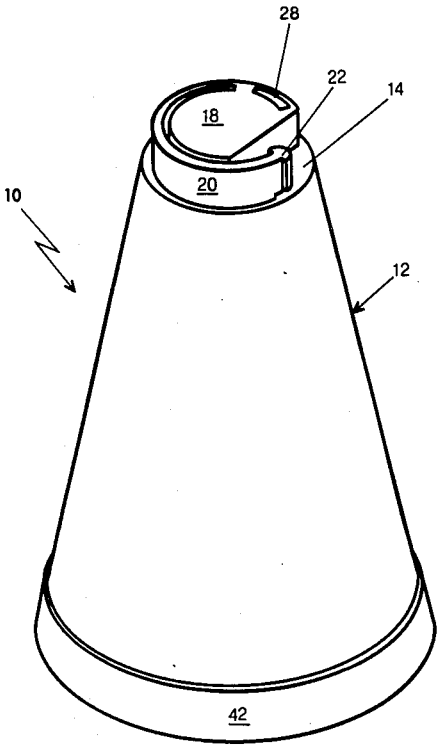
FIG. 1 is a perspective view of the novel container.
Figure 3A:
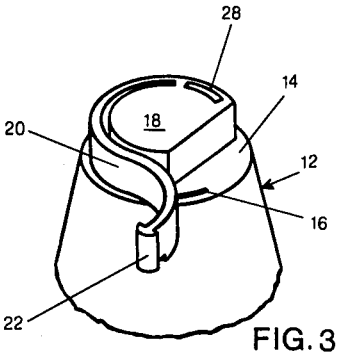
FIG. 3*a* is a partial perspective view of the novel container illustrating the manner in which the ridge member is separated from the closure top wall member.
Figure 3B:
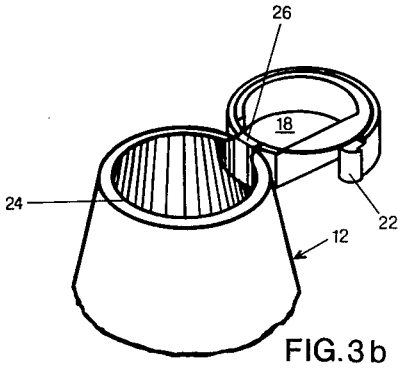
FIG. 3*b* is a partial perspective view of the novel container illustrating the tab-like closure member captured in its open position.

The novel container with its easy opening top member will be described by referring to FIGS. 1–6. The container is generally designated numeral 10. It has a body portion 12 and a closure top wall member 14. The inner surface of closure top wall member 14 has a groove 16 that defines a tab-like closure member 18. Extending upwardly from the outer surface of closure top wall member 14 is a ridge member 20. The lower surface of ridge member 20 is frangibly connected to the outer surface of closure top wall member 14.

A gripping member 22 is formed adjacent the free end of ridge member 20 and when a lateral pull is applied to gripping member 22, it will frangibly tear the bottom of ridge member 20 from the closure top wall member 14 leaving tab-like closure member 18 free to be lifted upwardly. When tab-like closure member 18 is lifted upwardly, the groove 16 will have been transformed into an aperture 24 in the top wall of the container. The portion where the tab-like closure top wall member 18 remains in intregrally formed with closure top wall member 14 forms a hinge portion 26.

Figure 4:
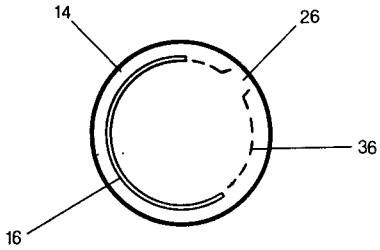
FIG. 4 is a top planned view of the novel container with the top of the tab-like closure member removed for clarity.

The tab-like closure member 18 has a recess lock aperture 28 formed on its top surface that mates with a protrusion 30 extending upwardly in the relieved area 32 of body portion 12. A lip 34 may also extend upwardly from the top surface of closure top wall member 14 adjacent the periphery of aperture 24. Tear lines 36 are indicated in FIG. 4 to define portions of the aperture 24 that are later formed when the tab-like closure member has been hinged upwardly.

Figure 2A:
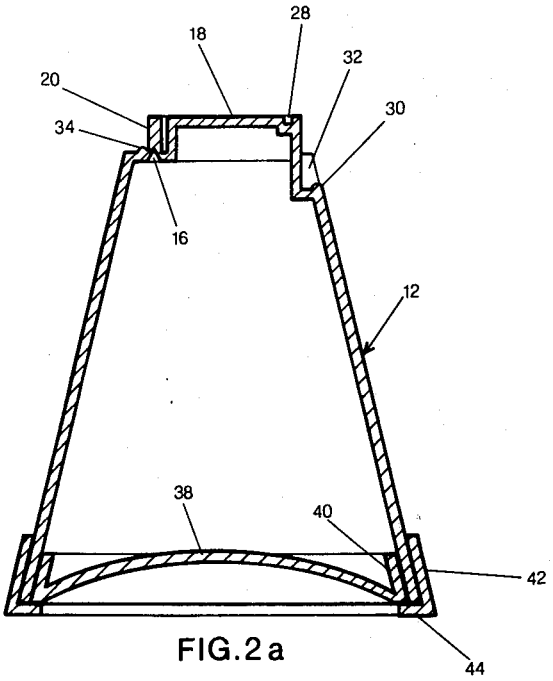
FIG. 2*a* is a vertical cross sectional view of the novel container.
Figure 2B:
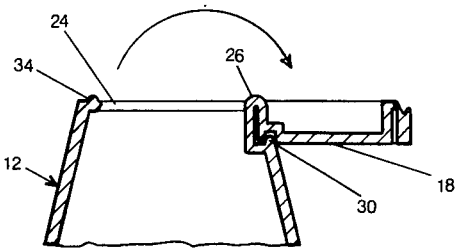
FIG. 2*b* is a partial side elevation view of the novel container illustrating the tab-like closure member captured in its open position.
Figure 5:
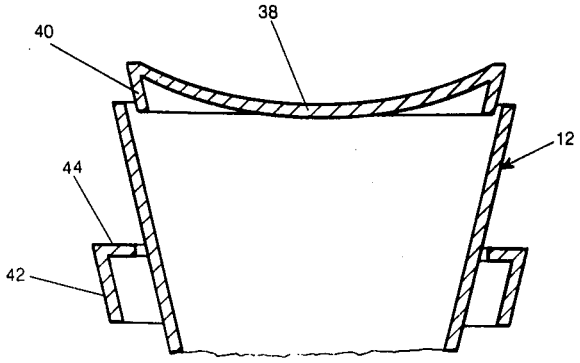
FIG. 5 is a partial side elevation view illustrating how the bottom wall is attached to the body of the container.

The bottom of the container structure is best illustrated in FIGS. 1, 2*a*, and FIG. 5. A bottom wall member 38 is seen to have an upstanding annular flange 40. This bottom wall member 38 telescopes within the side walls of body portion 12. Bottom wall member 38 is then captured in position by annular securing ring member 42 that has an inwardly extending annular flange portion 44. The manner in which these three parts are assembled is readily understood from FIG. 5. Initially the body portion 12 would be inverted so that the container could be filled. The bottom wall member 88 then would be inserted into the open end of body portion 12. Annular securing ring member 42 would then be slid upwardly until its flange 44 could pass the end of the side walls of body member 12 while pressing it inwardly until it would snap over the end and capture bottom wall member 38 in place.

Figure 6:
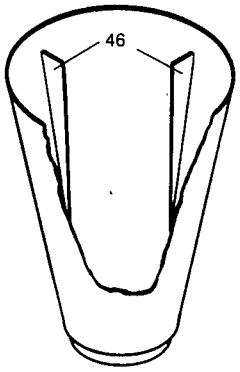
FIG. 6 is a perspective view illustrating an alternative embodiment of the body portion.

In FIG. 6 the body portion 12 is illustrated in an alternative form with inwardly directed ridge portions 46 that add structural reinforcement to the body portion.

Figure 7A:
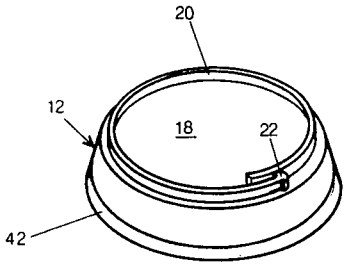
FIG. 7*a* is a perspective view of an alternative configuration for the novel container.
Figure 7B:
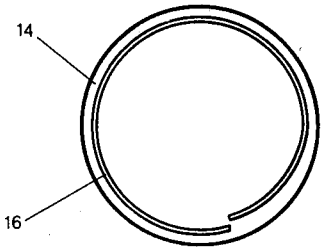
FIG. 7*b* is a top plan view of the alternative container illustrated in FIG. 7*a* with the top of the tab-like closure member removed for clarity.
Figure 8A:
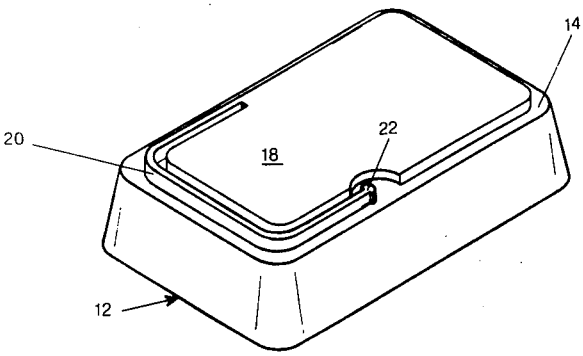
FIG. 8*a* is a perspective view of a second alternative configuration for the novel container.
Figure 8B:
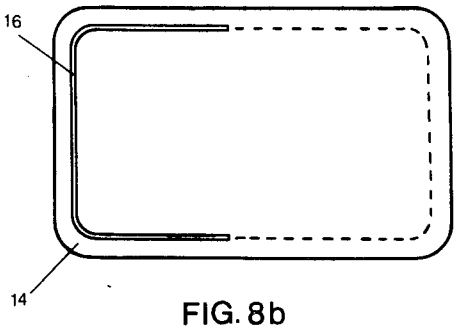
FIG. 8*b* is a top plan view of the container illustrated in FIG. 8*a* with the top of the tab-like closure member removed for clarity.

The alternative embodiments illustrated in FIGS. 7*a* and 8*a* illustrate different configurations that the body portion may assume. In each of these figures, like numerals are used to identify like structural members as they relate to the container illustrated in FIG. 1.

Figure 9:
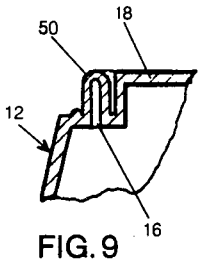
FIG. 9 is a partial side cross-sectional view of an alternative ridge member structure for the top closure wall member.

In FIG. 9, an alternative configuration for the ridge number is designated numeral 50. It is illustrated as having a cross sectional form in the nature of an inverted U-shaped ridge member.

What is claimed is:

1. A container comprising:

a body portion having a closure wall member of a predetermined thickness, said closure wall member having an outer surface and an inner surface;

groove means on said inner surface defining a tab-like closure member; amd gripping means on said outer surface which is frangibly connected to the outer surface of said closure wall member whereby when said gripping means is frangibly separated from the outer surface of said closure wall member, said tab-like closure member can be lifted upwardly to expose the interior of the body portion of the container.

2. A container as recited in claim 1 wherein said gripping means is positioned on said outer surface of said closure wall member opposite groove means.

3. A container as recited in claim 1 wherein said gripping means comprises a ridge member extending outwardly from the outer surface of said closure wall member.

4. A container as recited in claim 1 wherein said body portion is frusto-conically shaped and it has a bottom wall member.

5. A container as recited in claim 4 wherein said bottom wall member has a concave bottom surface with an upstanding annular flange that telescopically mates with the bottom of said body portion.

6. A container as recited in claim 5 further comprising an annular securing ring member having an inwardly extend flange around its bottom inner edge that captures the bottom of both said bottom wall member and said body portion to prevent their separation.

7. A container as recited in claim 1 wherein said body portion is rectangularly shaped and it has a bottom wall member.

8. A container as recited in claim 1 wherein said tab-like closure member has a hinge portion.

9. A container as received in claim 8 wherein the outer surface of said tab-like closure member has recessed hold-down locking means for locking the tab-like closure member in and open position.

10. A container as recited in claim 4 wherein said body portion has a plurality of inwardly extending ridge members for structurally reinforcing the body portions.

11. A container as recited in claim 3 wherein said ridge member has an inverted U-shaped cross section configuration.

12. A container as recited in claim 1 wherein said closure wall member is made of plastic.

* * * * *